US008242999B2

(12) United States Patent
Lin et al.

(10) Patent No.: US 8,242,999 B2
(45) Date of Patent: Aug. 14, 2012

(54) DRIVING METHOD AND DEVICE FOR GENERATING ACTIVATING SIGNALS THAT SERVE TO ACTIVATE SCAN LINES OF A DISPLAY PANEL, AND METHOD FOR ADJUSTING PULSE DURATIONS OF THE ACTIVATING SIGNALS

(75) Inventors: Po-Chih Lin, Taipei (TW); Cheng-Che Ho, Taipei (TW)

(73) Assignee: Integrated Solutions Technology, Inc., Taipei (TW)

( * ) Notice: Subject to any disclaimer, the term of this patent is extended or adjusted under 35 U.S.C. 154(b) by 898 days.

(21) Appl. No.: 12/345,779

(22) Filed: Dec. 30, 2008

(65) Prior Publication Data

US 2010/0026668 A1 Feb. 4, 2010

(30) Foreign Application Priority Data

Jul. 31, 2008 (TW) ..... 97129025 A

(51) Int. Cl.
*G09G 3/36* (2006.01)

(52) U.S. Cl. ..... 345/94; 345/208

(58) Field of Classification Search ..... 345/87–100, 345/204, 208

See application file for complete search history.

(56) References Cited

U.S. PATENT DOCUMENTS 6,822,630 B2 * 11/2004 Moriwaki ..... 345/87
2009/0040168 A1 * 2/2009 Liu ..... 345/100

* cited by examiner

*Primary Examiner* — Regina Liang
(74) *Attorney, Agent, or Firm* — Choate, Hall & Stewart, LLP

(57) ABSTRACT

A driving method for generating activating signals that serve to activate scan lines of a display panel includes generating the activating signals based on a plurality of recorded pulse duration information to thereby permit a time point at which a pulse duration of a preceding one of the activating signals in a consecutive pair ends occurs prior to a time point at which a pulse duration of a succeeding one of the activating signals in the consecutive pair starts. A driving device that performs the driving method is also disclosed. A method for adjusting pulse durations of the activating signals is further disclosed.

9 Claims, 5 Drawing Sheets

DRIVING METHOD AND DEVICE FOR GENERATING ACTIVATING SIGNALS THAT SERVE TO ACTIVATE SCAN LINES OF A DISPLAY PANEL, AND METHOD FOR ADJUSTING PULSE DURATIONS OF THE ACTIVATING SIGNALS

CROSS-REFERENCE TO RELATED APPLICATION

This application claims priority of Taiwanese Application No. 097129025, filed on Jul. 31, 2008, which is incorporated herein by reference in its entirety.

BACKGROUND OF THE INVENTION

1. Field of the Invention

This invention relates to a driving method and device for generating activating signals that serve to activate scan lines of a display panel.

2. Description of the Related Art

Liquid crystal displays (LCD) are well known in the art and have largely replaced cathode-ray tubes (CRT) in view of their thin profile and lightweight characteristics. The LCD may be of the twisted nematic (TN) type, the super-twisted nematic (STN) type, or the thin film transistor (TFT) type. The TFT type LCD is relatively expensive to manufacture when compared to the TN and STN type LCD. Therefore, the TN and STN type LCD are often used for mobile phones and digital cameras. FIG. 1 illustrates a conventional STN type LCD that includes a display panel 92 and a driving device 91. The display panel 92 has a plurality of scan lines (Com1 to ComN). The driving device 91 is connected to the scan lines (Cora1 to ComN) of the display panel 92, and is 2 operable so as to generate activating signals that serve to activate the scan lines (Com1 to ComN) of the display panel 92 in a progressive scanning manner.

The aforementioned conventional STN type LCD is disadvantageous in that, with further reference to FIG. 2, the driving device 91 thereof generates the activating signals such that a time point at which a pulse duration of a preceding one of the activating signals, e.g., the activating signal (Si), in a consecutive pair of the activating signals ends and a time point at which a pulse duration of a succeeding one of the activating signals, i.e., the activating signal (S2), in the consecutive pair starts occur simultaneously, e.g., at a time point (t32). However, due to non-ideal effects, e.g., uneven loading effects, of the scan lines (Com1 to ComN), the activating signals (S1, S2) are attenuated, and as a consequence, the time point (t33) at which the pulse duration of the activating signal (S1') ends may occur after the time point (t32) at which the pulse duration of the activating signal (S2') starts. That is, the activating signal (S2')begins to activate one of the scan lines (Com1 to ComN), e. g. , the scan line (Com2), in an adjacent pair of the scan lines (Com1 to ComN) before the activating signal (S1') has completely deactivated the other of the scan lines (Com1 to ComN), e.g., the scan line (Com1), in the adjacent pair. This easily arises in crosstalk between he scan lines (Com1, Com2) and results in a "shadow" appearing on the display panel 92 of the conventional STN type LCD.

Furthermore, since the scan lines (Com1 to ComN) have different lengths and therefore different non-ideal effects, the scan lines (Com1 to ComN) attenuate the activating signals at different degrees. In particular, the scan line (Com1), which has the shortest length, attenuates the activating signal (Si) the least, whereas the scan line (ComN), which has the longest length, attenuates the activating signal (Sn) the most.

To solve the above-mentioned problems, it has been proposed to gradually increase the widths of the scan lines (Com1 to ComN) from the shortest scan line (Cora1) to the longest scan line (ComN). This approach, however, results in a larger area, e.g., of a circuit board (not shown), occupied by the scan lines (Com1 to ComN). Such problem becomes even more serious for display panels having a large number of scan lines. In addition, since the degree at which the width of the scan line (Corn] to ComN) is increased is determined based on a particular type of the display panel 92, once the scan lines (Com1 to ComN) are formed, e.g., on the circuit board, the widths thereof are not capable of being altered to suit a different type of display panel.

SUMMARY OF THE INVENTION

Therefore, an object of the present invention is to provide a driving method for generating activating signals, which serve to activate scan lines of a display panel, that can overcome the aforesaid drawbacks of the prior art.

Another object of the present invention is to provide a driving device that performs the driving method.

Yet another object of the present invention is to provide a display that includes the driving device.

Still another object of the present invention is to provide a method for adjusting pulse durations of the activating signals.

According to a first aspect of the present invention, a driving method for generating activating signals that serve to activate scan lines of a display panel comprises generating the activating signals based on a plurality of recorded pulse duration information to thereby permit a time point at which a pulse duration of a preceding one of the activating signals in a consecutive pair ends occurs prior to a time point at which a pulse duration of a succeeding one of the activating signals in the consecutive pair starts.

According to a second aspect of the present invention, a method for adjusting pulse durations of activating signals that serve to activate scan lines of a display panel comprises:

A) determining a time point at which a pulse duration of a preceding one of the activating signals in a consecutive pair of the activating signals ends;

B) determining a time point at which a pulse duration of a succeeding one of the activating signals in the consecutive pair starts;

C) calculating the difference between the time points determined in steps A) and B); and D) adjusting the pulse duration of at least one of the activating signals in the consecutive pair based on the difference calculated in step C) such that the time point at which the pulse duration of the preceding one of the activating signals in the consecutive pair ends occurs prior to the time point at which the pulse duration of the succeeding one of the activating signals in the consecutive pair starts.

According to a third aspect of the present invention, a driving method for generating activating signals that serve to activate scan lines of a display panel comprises:

A) Adjusting pulse durations of the activating signals, wherein step A) includes the sub-steps of a1) determining a time point at which a pulse duration of a preceding one of the activating signals in a consecutive pair of the activating signals ends, a2) determining a time point at which a pulse duration of a succeeding one of the activating signals in the consecutive pair starts, a3) calculating the difference between the time points determined in sub-steps a1) and a2), and a4) adjusting the pulse duration of at least one of the activating signals in the consecutive pair based on the difference calculated in sub-step a3) such that the time point at which the pulse duration of the preceding one of the activating signals in the consecutive pair ends occurs prior to the time point at which the pulse duration of the succeeding one of the activating signals in the consecutive pair starts;

B) recording the pulse durations of the activating signals adjusted in step A); and C) generating the activating signals based on the pulse durations recorded in step B).

According to a fourth aspect of the present invention, a driving device for generating activating signals that serve to activate scan lines of a display panel comprises a storage unit and an activating unit. The storage unit serves to record a plurality of pulse duration information therein. The activating unit is coupled to the storage unit, and is operable so as to generate the activating signals based on the pulse duration information recorded in the storage unit. The pulse duration information enables the activating unit to generate the activating signals such that a time point at which a pulse duration of a preceding one of the activating signals in a consecutive pair ends occurs prior to a time point at which a pulse duration of a succeeding one of the activating signals in the consecutive pair starts.

According to a fifth aspect of the present invention, a display comprises a display panel and a driving device. The display panel has a plurality of scan lines. The driving device is coupled to the display panel, is operable so as to generate activating signals that serve to activate the scan lines of the display panel in sequence, and includes a storage unit and an activating unit. The storage unit records a plurality of pulse duration information therein. The activating unit is coupled to the storage unit and the display panel, and is operable so as to generate the activating signals based on the pulse duration information recorded in the storage unit. The pulse duration information enables the activating unit to generate the activating signals such that a time point at which a pulse duration of a preceding one of the activating signals in a consecutive pair ends occurs prior to a time point at which a pulse duration of a succeeding one of the activating signals in the consecutive pair starts.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION

Figure 1:
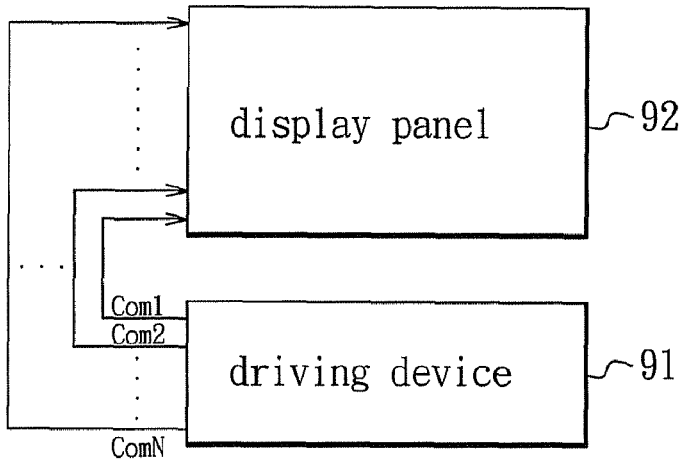
FIG. 1 PRIOR ART
FIG. 1 is a block diagram illustrating a display panel and a driving device of a conventional super-twisted nematic (STN) type liquid crystal display (LCD)
Figure 2:
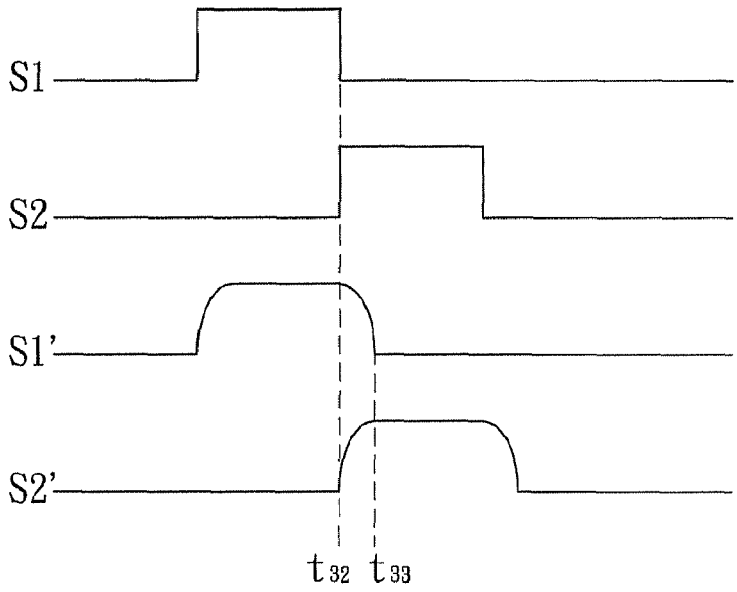
FIG. 2 PRIOR ART
FIG. 2 is a timing diagram illustrating a consecutive pair of activating signals generated by the driving device of the conventional STN type LCD.
Figure 3:
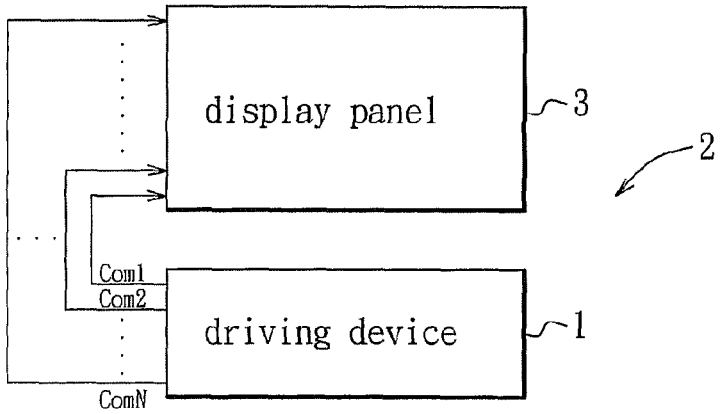
FIG. 3 is a block diagram of an embodiment of a driving device connected to scan lines of a display panel.
Figure 4:
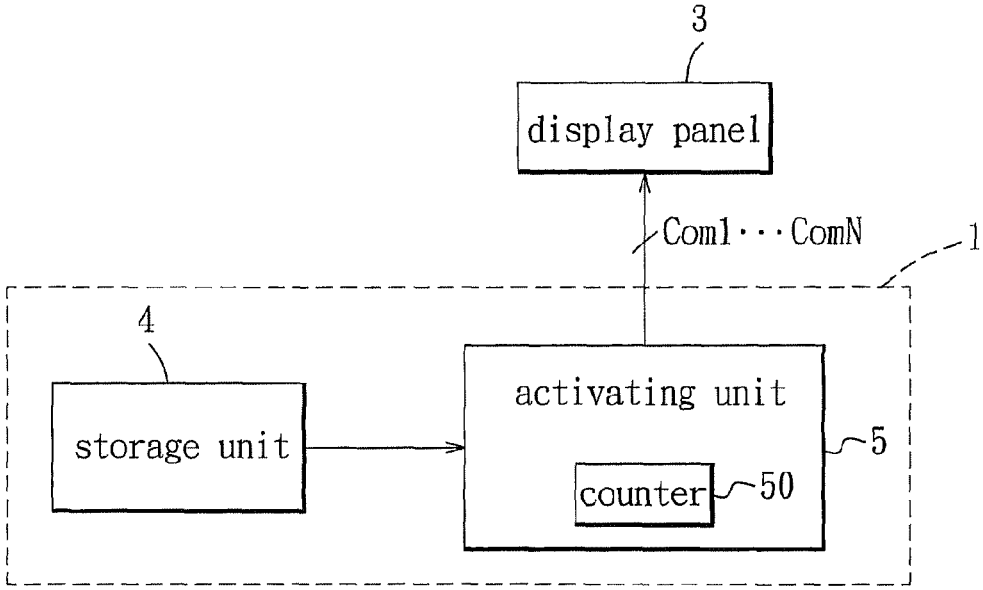
FIG. 4 is a block diagram illustrating a storage unit and an activating unit of an embodiment of a driving device.

Referring to FIGS. 3 and 4, an embodiment of a driving device 1 for a display 2 is shown to include a storage unit 4 and an activating unit 5.

In this embodiment, the display 2 is a super-twisted nematic (STN) type liquid crystal display (LCD), and includes a display panel 3 that has a plurality of scan lines (Com1 to ComN).

The driving device 1 is operable so as to generate activating signals that serve to activate the scan lines (Com1 to ComN) of the display panel 3 in sequence, i.e., in a progressive scanning manner.

The storage unit 4 serves to record a plurality of pulse duration information therein. In this embodiment, the storage unit 4 may be a computer memory or a circuit that is capable of recording digital information therein.

The activating unit 5 is connected to the storage unit 4 and the scan lines (Com1 to ComN) of the display panel 3. In this embodiment, the activating unit 5 is operable so as to generate the activating signals based on the pulse duration information recorded in the storage unit 4. The pulse duration information enables the activating unit 5 to generate the activating signals such that a time point at which a pulse duration of a preceding one of the activating signals in a consecutive pair of the activating signals ends occurs prior to a time point at which a pulse duration of a succeeding one of the activating signals in the consecutive pair starts.

It is noted that each of the pulse duration information is recorded in the storage unit 4 in a form of a binary code, the number of bits of which represents a resolution of a pulse duration of the activating signal generated by the driving device 1.

In this embodiment, the activating unit 5 generates the activating signals such that the activating signals are arranged into groups of consecutive activating signals and such that the activating signals in one of the groups are generated based on one of the pulse duration information recorded in the storage unit 4, thereby reducing the number of the pulse duration information required to be recorded in the storage unit 4.

The activating unit 5 includes a counter 50 that is operable so as to output count values starting from one to the total number of the scan lines (Com1 to ComN), in increments of one. In this embodiment, the activating unit 5 generates the activating signal based on the pulse duration information and with reference to the count value outputted by the counter 50.

Figure 5:
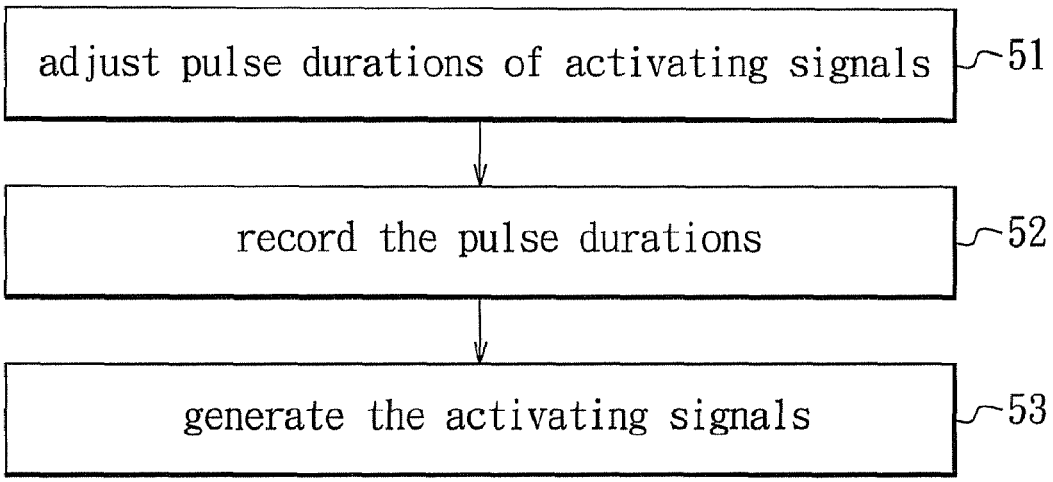
FIG. 5 is a flowchart of an embodiment of a driving method for generating activating signals that serve to activate the scan lines of the display panel to be implemented using the driving device shown in FIG. 3.

An embodiment of a driving method for generating the activating signals will now be described with further reference to FIG. 5.

In step 51, the pulse durations of the activating signals are adjusted.

In this embodiment, step 51 includes the sub-steps of:

511) enabling the activating unit 5 to generate a consecutive pair of the activating signals based on one of the pulse duration information recorded in the storage unit 4;

512) determining a time point at which a falling edge of a pulse duration of a preceding one of the activating signals in a consecutive pair of the activating signals ends;

513) determining a time point at which a rising edge of a pulse duration of a succeeding one of the activating signals in the consecutive pair starts;

514) calculating the difference between the time points determined in sub-steps 512) and 513); and 515) adjusting the pulse duration of at least one of the activating signals in the consecutive pair based on the difference calculated in sub-step 514) such that the time point at which the falling edge of the pulse duration of the preceding one of the activating signals in the consecutive pair ends occurs prior to the time point at which the rising edge of the pulse duration of the succeeding one of the activating signals in the consecutive pair starts;

In this embodiment, this sub-step may be performed by one of the following:

a) shorten the pulse duration of the preceding one of the activating signals in the consecutive pair by advancing the time point determined in sub-step 512) by an amount equal to or greater than the difference calculated in sub-step 514);

b) shorten the pulse duration of the succeeding one of the activating signals in the consecutive pair by delaying the time point determined in sub-step 513) by an amount equal to or greater than the difference calculated in sub-step 514); and c) shorten the pulse durations of the activating signals in the consecutive pair by advancing the time point determined in sub-step 512) by a first amount and by delaying the time point determined in sub-step 513) by a second amount, in which the sum of the first and second amounts is equal to or greater than the difference calculated in sub-step 514).

In step 52, the pulse durations of the activating signals adjusted in step 51 are recorded in the storage unit 4.

Finally, in step 53, the activating unit 5 is enabled to generate the activating signals based on the pulse durations recorded in step 52.

Figure 6:
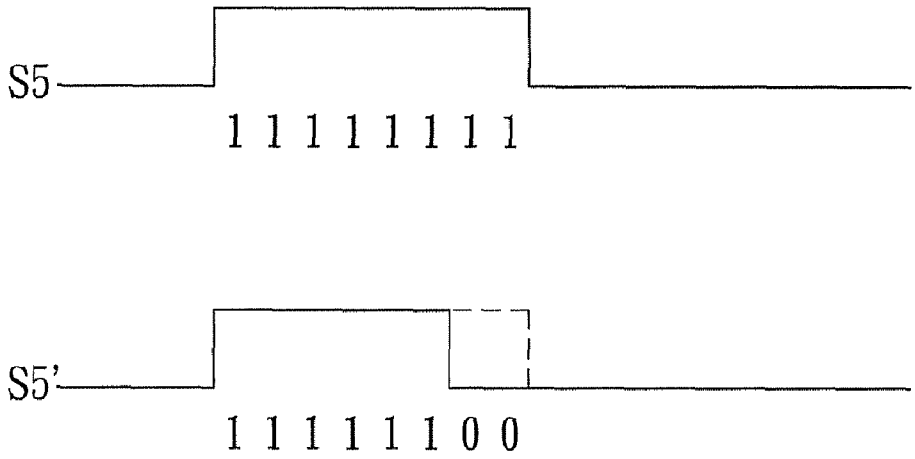
FIGS. 6 and 7 are schematic diagrams illustrating pulse duration information recorded in the storage unit.
Figure 7:
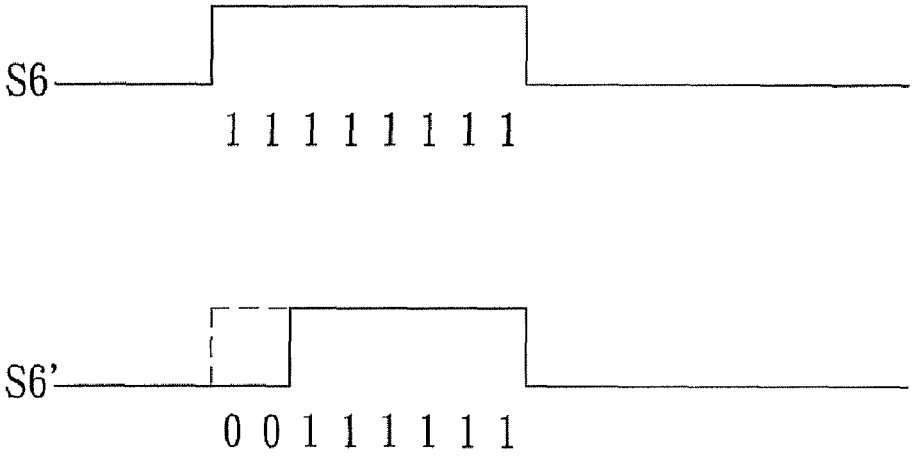
Figure 8:
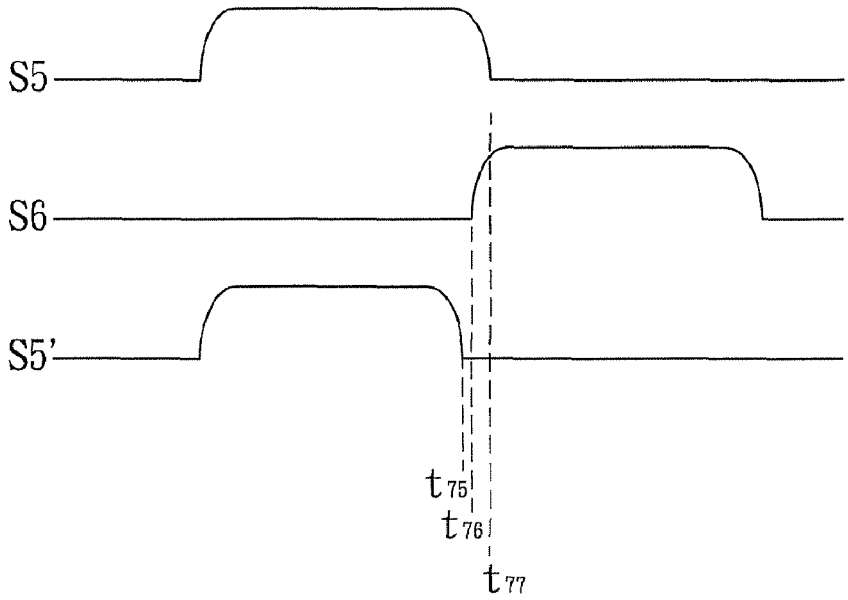
FIGS. 8 and 9 are timing diagrams illustrating a consecutive pair of the activating signals generated by of an embodiment of a driving device.

As an illustrative example of step 51, suppose in sub-step 511), as illustrated in FIGS. 6 and 7, a consecutive pair of the activating signals, i.e., the activating signals (S5, S6), are generated based on pulse duration information, which has a binary code of "11111111". Further suppose, as illustrated in FIG. 8, a time point (t77) at which a falling edge of a pulse duration of a preceding one of the activating signals, i.e., the activating signal (S5), ends occurs after a time point (t76) at which a succeeding one of the activating signals, i.e., the activating signal (S6), starts. In this case, the time points (t77, t76) are determined in sub-steps 512) and 513), respectively, and the difference between the time point (t77) and the time point (t76) is calculated in sub-step 514). Thus, in sub-step 515), one of the following is performed:

a) the pulse duration of the activating signal (S5) is shortened by advancing the time point (t77) by an amount greater than the difference calculated in sub-step 514), whereby, as best shown in FIG. 8, the time point (t75) at which the falling edge of the pulse duration of the activating signal (S5') ends occurs prior to the time point (t76) at which the rising edge of the pulse duration of the activating signal (S6) starts.

Figure 9:
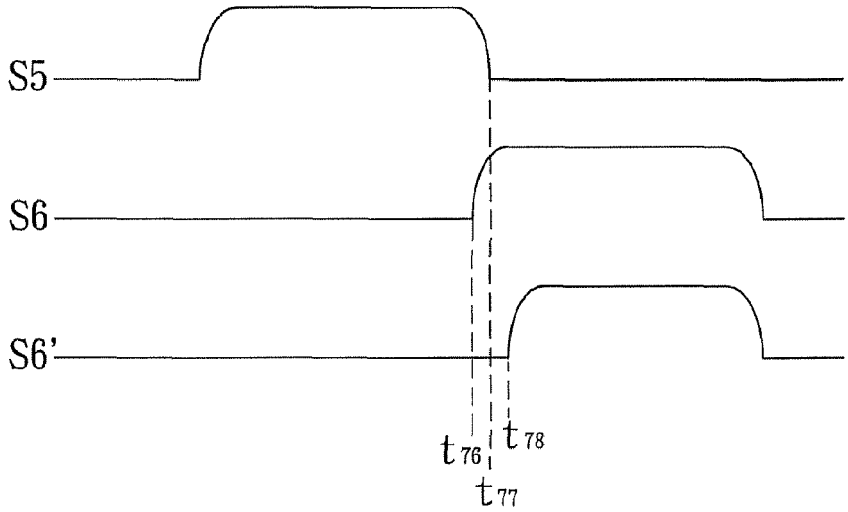

As illustrated in FIG. 6, the time point (t77) is advanced to the time point (t75) by altering the binary code of the pulse duration information recorded in the storage unit 4 and corresponding to the activating signal (S5) from "11111111" to "11111100";

b) the pulse duration of the activating signal (S6) is shortened by delaying the time point (t76) by an amount greater than the difference calculated in sub-step 514), whereby, as shown in FIG. 9, the time point (t77) at which the falling edge of the pulse duration of the activating signal (S5) ends occurs prior to the time point (t78) at which the rising edge of the pulse duration of the activating signal (S6') starts.

As illustrated in FIG. 7, the time point (t76) is delayed to the time point (t78) by altering the binary code of the pulse duration information recorded in the storage unit 4 and corresponding to the activating signal (S6) from "11111111" to "00111111"; and c) the pulse durations of the activating signals (S5, S6) are shortened by advancing the time point (t77) by a first amount and by delaying the time point (t76) by a second amount, wherein the sum of the first and second amounts is greater than the difference calculated in sub-step 514), whereby the time point at which the falling edge of the pulse duration of the activating signal (S5) ends occurs prior to the time point at which the rising edge of the pulse duration of the activating signal (S6) starts.

The time point (t77) is advanced by the first amount and the time point (t76) is delayed by the second amount by altering the binary code of the pulse duration information recorded in the storage unit 4 and corresponding to the activating signals (S5, S6) from "11111111" to "01111110".

From the above description, since the activating unit 5 generates the activating signals based on the pulse duration information recorded in the storage unit 4 to thereby permit a time point at which a pulse duration of a preceding one of the activating signals in a consecutive pair ends occurs prior to a time point at which a pulse duration of a succeeding one of the activating signals in the consecutive pair starts, crosstalk between an adjacent pair of the scan lines (Cora1 to ComN) is prevented. Furthermore, since the pulse duration information is recorded in the storage unit 4, the pulse duration information may be altered to suit a different display panel product by simply performing a write operation on the storage unit 4, in a manner well known in the art.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A method for adjusting pulse durations of activating signals that serve to activate scan lines of a display panel, said method comprising:

A) determining a time point at which a pulse duration of a preceding one of the activating signals in a consecutive pair of the activating signals ends;

B) determining a time point at which a pulse duration of a succeeding one of the activating signals in the consecutive pair starts;

C) calculating the difference between the time points determined in steps A) and B); and D) adjusting the pulse duration of at least one of the activating signals in the consecutive pair based on the difference calculated in step C) such that the time point at which the pulse duration of the preceding one of the activating signals in the consecutive pair ends occurs prior to the time point at which the pulse duration of the succeeding one of the activating signals in the consecutive pair starts.

2. The method as claimed in claim 1, wherein, in step D), the pulse duration of the preceding one of the activating signals in the consecutive pair is shortened by advancing the time point determined in step A) by an amount not less than the difference calculated in step C).

3. The method as claimed in claim 1, wherein, in step D), the pulse duration of the succeeding one of the activating signals in the consecutive pair is shortened by delaying the time point determined in step B) by an amount not less than the difference calculated in step C).

4. The method as claimed claim 1, wherein, in step D), the pulse durations of the activating signals in the consecutive pair are shortened by advancing the time point determined in step A) by a first amount and by delaying the time point determined in step B) by a second amount, and the sum of the first and second amounts if not less than the difference calculated in step C).

5. A driving method for generating activating signals that serve to activate scan lines of a display panel, said driving method comprising:

A) adjusting pulse durations of the activating signals, wherein step A) includes the sub-steps of a1) determining a time point at which a pulse duration of a preceding one of the activating signals in a consecutive pair of the activating signals ends, a2) determining a time point at which a pulse duration of a succeeding one of the activating signals in the consecutive pair starts, a3) calculating the difference between the time points determined in sub-steps a1) and a2), and a4) adjusting the pulse duration of at least one of the activating signals in the consecutive pair based on the difference calculated in sub-step a3) such that the time point at which the pulse duration of the preceding one of the activating signals in the consecutive pair ends occurs prior to the time point at which the pulse duration of the succeeding one of the activating signals in the consecutive pair starts;

B) recording the pulse durations of the activating signals adjusted in step A); and C) generating the activating signals based on the pulse durations recorded in step B).

6. The driving method as claimed in claim 5, wherein, in sub-step a4), the pulse duration of the preceding one of the activating signals in the consecutive pair is shortened by advancing the time point determined in sub-step a1) by an amount not less than the difference calculated in sub-step a3).

7. The driving method as claimed in claim 5, wherein, in sub-step a4), the pulse duration of the succeeding one of the activating signals in the consecutive pair is shortened by delaying the time point determined in sub-step a2) by an amount not less than the difference calculated in sub-step a3).

8. The driving method as claimed claim 5, wherein, in sub-step a4) , the pulse durations of the activating signals in the consecutive pair are shortened by advancing the time point determined in sub-step a1) by a first amount and by delaying the time point determined in sub-step a3) by a second amount, and the sum of the first and second amounts is not less than the difference calculated in sub-step a3).

9. The driving method as claimed in claim 5, wherein the activating signals are arranged into groups of consecutive activating signals, and the activating signals in one of the groups are generated based on one of the pulse durations recorded in step B).

* * * * *